US007485792B2

(12) United States Patent
Collins, Sr.

(10) Patent No.: US 7,485,792 B2
(45) Date of Patent: Feb. 3, 2009

(54) EFFECTS PEDAL RETAINING UNIT AND PEDAL BOARD SYSTEM

(76) Inventor: Max Collins, Sr., 2202 Rockhaven Dr., Houston, TX (US) 77082

( * ) Notice: Subject to any disclaimer, the term of this patent is extended or adjusted under 35 U.S.C. 154(b) by 250 days.

(21) Appl. No.: 11/455,988

(22) Filed: Jun. 21, 2006

(65) Prior Publication Data

US 2007/0295190 A1 Dec. 27, 2007

(51) Int. Cl.
*G10D 13/02* (2006.01)

(52) U.S. Cl. ..... 84/422.1

(58) Field of Classification Search ..... 84/422.1, 84/422.2, 422.3, 353, 426, 366
See application file for complete search history.

(56) References Cited

U.S. PATENT DOCUMENTS 4,262,576 A * 4/1981 Gorsky et al. ..... 84/422.1
4,445,415 A 5/1984 Izquierdo
5,866,829 A 2/1999 Pecoraro
6,215,055 B1 4/2001 Saravis
6,538,185 B1 3/2003 Stratton
6,723,909 B1 * 4/2004 Hooper, II ..... 84/453
6,967,272 B2 11/2005 Green
2003/0071787 A1 * 4/2003 Gerstacker ..... 345/163
2004/0250673 A1 12/2004 Salerno

OTHER PUBLICATIONS

Website featuring pedal board, Boss BCB-60 (http://www.bosscorp.co.jp/products/en/BCB-60).
Website featuring Pedal Board Cases (http://www.coreoneproduct.com/pages/productindex.php3?itemref=pc-55).
Website featuring Furman SP-8 Pedal Board (http://www.furmansound.com/products/pro/pdlbrd.index.php).

* cited by examiner

*Primary Examiner*—Kimberly R Lockett
(74) *Attorney, Agent, or Firm*—John Karl Buche

(57) ABSTRACT

A musical effects pedal retaining unit comprising a retaining body, a retaining means affixed to said retaining body by retaining means connectors and an attachment surface fixed to said retaining body. This pedal retaining unit is preferably used with a pedal board system to secure at least one musical effect pedal while simultaneously preserving the effects pedal.

12 Claims, 3 Drawing Sheets

EFFECTS PEDAL RETAINING UNIT AND PEDAL BOARD SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The present application relates to the field of musical instrument effects pedals and pedal boards.

2. Background of the Invention

A musical instrument effects pedal is a small device inserted into the signal path, between the instrument and the amplification unit, of electrical musical instruments in order to alter the sound quality of the signal. The musician switches between the "clean" or unaltered sound, and the "affected" sound by activating a switch with his or her foot—thus the "pedal" nomenclature. Effects pedals have been widely used since the 1960's, and a lucrative niche market has arisen for the resale of highly sought-after vintage pedals. A problem arises however, in that musicians seek to preserve the condition, and thus the value, of their pedals while at the same time utilizing them musically. A prominent type of damage to valuable pedals occurs when musicians attempt to stabilize them to their "pedal boards," a device by which pedals are grouped together to allow for easier access when playing (See FIG. 7). The commonplace means for attaching a pedal to a pedal board is the ubiquitous fabric hook and loop fastener system, as has been marketed under Velcro® tradeamarks. However, in order to adhere one side of such a fabric hook and loop fastener system to the pedal, a person must subject his or her valuable pedal to the sticky, corrosive substance present on the adhesive side of the system. This adhesive substance is extremely difficult to remove and greatly depreciates the value of the pedal upon resale.

Therefore, what is needed is an effects pedal retaining unit to effectively stabilize a musical effects pedal in proper relation to a pedal board, without the use of damaging adhesive.

There are a variety of pedal boards on the market and disclosed in the prior art, however, none accomplish the benefits of the various embodiments disclosed herein by Applicant. For example, among the various pedal boards on the market are the Boss BCB-60 (http://www.bosscorp.co.jp/products/en/BCB-60), the Core Equipment Pedal Board Cases (http://www.coreoneproduct.com/pages/productindex.php3?itemref=pc-55), the Furman SP-8 Pedal Board (http://www.furmansound.com/products/pro/pdlbrd/index.php), the Ergonomic Pedal Board described in U.S. patent application Ser. No. 10/459,223, and the Foot Pedal Board for Musical Instruments described in U.S. Pat. No. 6,215,055. All of these pedal boards are designed to accommodate multiple pedals and all use fabric hook-and-loop fasteners to stabilize the pedal with reference to the pedal board, however, none of these references adequately protect or preserve the pedals being used to a degree desired by typical collectors.

U.S. Pat. No. 5,866,829, to Pecororao (1999) and U.S. Pat. No. 6,538,185 to Stratton (2003) both disclose pedal rack systems, but neither of the technologies appear to solve the problems addressed by the present application. Thus, the primary shortcoming of these devices, and a primary problem that that Applicant seeks to remedy, is the necessity of applying damaging adhesive to the surface of valuable effects pedals. Additionally Applicant's device provides for greater pedal stability during musical performance, thereby assisting the musician to perform without focusing on the location or condition of his or her effects pedals.

SUMMARY OF THE INVENTION

Accordingly, it is an objective of the present application to provide a musical effects pedal retaining unit.

It is yet another object of the present application to provide a musical effects pedal retaining unit that stabilizes a musical effects pedal during use more effectively than existing technologies.

It is yet another object of the present application to provide a musical effects pedal retaining unit which stabilizes a musical effects pedal without requiring application of adhesive directly to the musical effects pedal.

Other objectives of the invention will become apparent to those skilled in the art once the invention has been shown and described. These objectives are not to be construed as limitations of applicant's invention, but are merely aimed to suggest some of the many benefits that may be realized by the apparatus of the present application and with its many embodiments.

BRIEF DESCRIPTION OF THE DRAWING

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments that will be appreciated by those reasonably skilled in the relevant arts. Also, drawings are not necessarily made to scale but are representative.

DETAILED DESCRIPTION OF THE INVENTION

Figure 1:
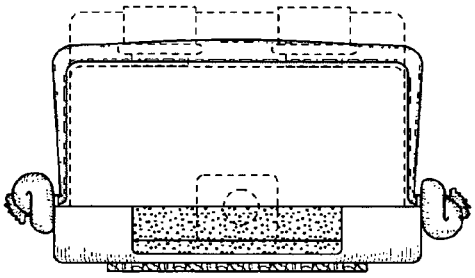
FIG. 1 is a front perspective drawing of a preferable pedal retaining unit assembly.

FIG. 1 is a front perspective view of a preferable pedal retaining unit assembly 1. Basic components of the shown pedal retaining assembly 1 comprise a retaining body 2 with a preferable accommodation bracket 7, and an attachment surface 6. A preferable mode of use is that an effects pedal is removably placed in the retaining body 2 and stabilized via the retaining means 4. Power supply and other electrical cables to the pedals typically are fixed through the accommodation bracket 7. The pedal retaining unit 1 and pedal may then be placed as a whole and fastened at a desired location to a pedal board, preferably by an attachment surface 6 fixedly disposed on an underside of said retaining body 2. Thus, a user can properly locate and stabilize an effect pedal to a pedal board without resorting to the use of adhesives that damage the pedals. Applicant has found that the retaining body 2 may be fashioned from any rigid or semi-rigid material, such as any variety of metal or plastic having these qualities. Preferably, the retaining body 2 may further feature a lip 8 to better restrain the pedal. Specific materials capable of forming the retaining body 2 include, but are not limited to: metal alloys, tin, aluminum, steel, wood, polyethylene, polypropylene, polyethylene terepthalate, polyvinyl chloride, polycarbonate, or actrylonitrile butadiene styrene. Applicant has found the retaining means 4 functions best when fashioned out of material having elastic qualities such as rubber, latex, surgical tubing, isoprene, or elastic fabric. However non-elastic materials such as, but not limited to, rope, string, or leather may also function acceptably. The retaining means 4 is secured to the retaining body 2 via the retaining means connector 5. The retaining means may preferably take the form of a band, strap, or be formed from one or more bands. Power supply and other cables may exit the pedal retaining unit assembly 1 through the accommodation bracket 6. The pedal retaining unit assembly 1 may then be attached to an external surface, such as a pedal board 9, via the attachment surface 6. Applicant has found that the preferred material for the attachment surface 6 is likely to be a hook and loop fastener system, such sold under Velcro® trademarks. As previously mentioned, incorporation of this type of fastener into the attachment surface 6 is particularly beneficial inasmuch as it provides for easy compatibility with existing systems. However, one reasonably skilled in the art could envision any variety of fastening systems that would serve the same function, such as a rubber or cork surface, magnetic attachments, latching attachments, interlocking or sliding grooves.

Figure 2:
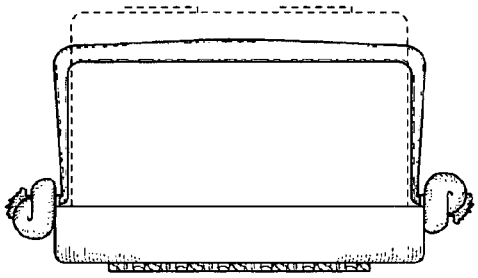
FIG. 2 is a rear perspective drawing of a preferable pedal retaining unit assembly.

FIG. 2 is a rear perspective view of the preferable pedal retaining unit assembly 1 depicting essentially the same features as FIG. 1. Noticeably absent from FIG. 2 is the accommodation bracket 7, because industry standard in the music effects pedal industry typically provides for power supply and other cables to exit the effects pedal via the top, or side of the pedal facing away from the user.

Figure 3:
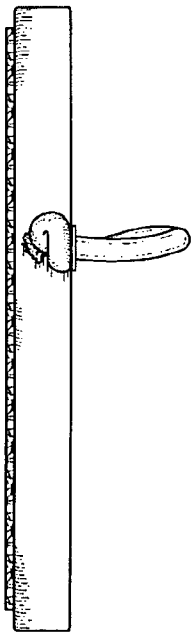
FIG. 3 is a side perspective view of a preferable pedal retaining unit assembly.
Figure 4:
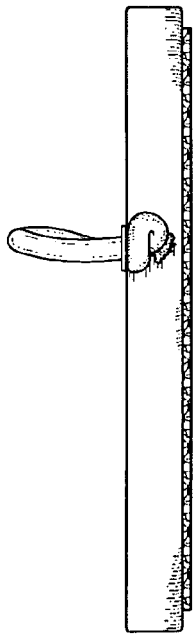
FIG. 4 is a side perspective view of a preferable pedal retaining unit assembly, as viewed from the opposite side as FIG. 3.

FIGS. 3 and 4 are side perspective views of the preferable pedal retaining unit assembly 1, showing in greater detail the retaining means connector 5. Applicant has found that the function of the retaining means connector 5 may be effectuated by any number of means including, but not limited to: an opening through which the retaining means 4 may pass, a buckle, a snap system, or permanent welding. One reasonably skilled in the art could envision any variety of fastening systems that would serve a similar function.

Figure 5:
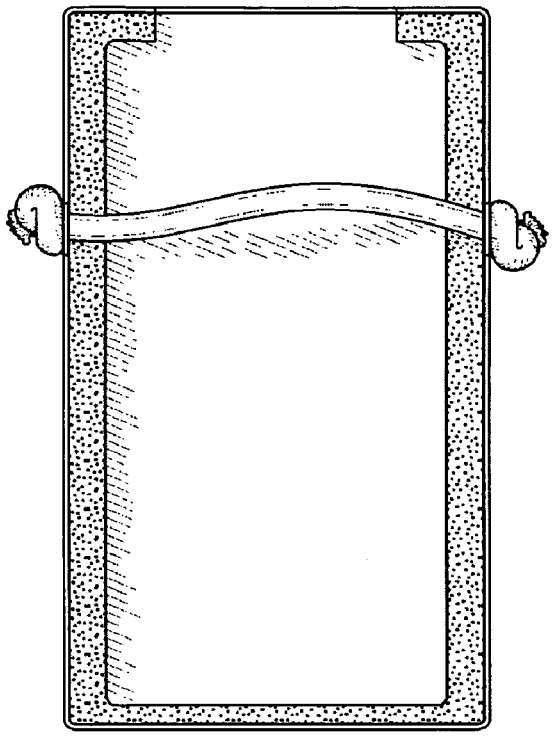
FIG. 5 is a top perspective view of a preferable pedal retaining unit assembly.

FIG. 5 is an overhead prospective view of the preferable pedal retaining unit assembly 1. The retaining body 2 and retaining body inner surface 3 are shown in their entirety. The retaining body 2 may be dimensioned to receive the industry standard size for effects pedals, which is approximately 2⅞ inches×5⅛ inches×2⅜ inches. However, one reasonably skilled in the art could modify the size of the retaining body 2 to accommodate any size effects pedal. The retaining body inner surface 3 functions to provide a soft, protective layer between the rigid material of the retaining body 2. Applicant has found this element may be best created using felt or other soft fabric, but one reasonably skilled in the art could utilize any material serving the same purpose, such as but not limited to: cork, padded vinyl, or polystyrene.

Figure 6:
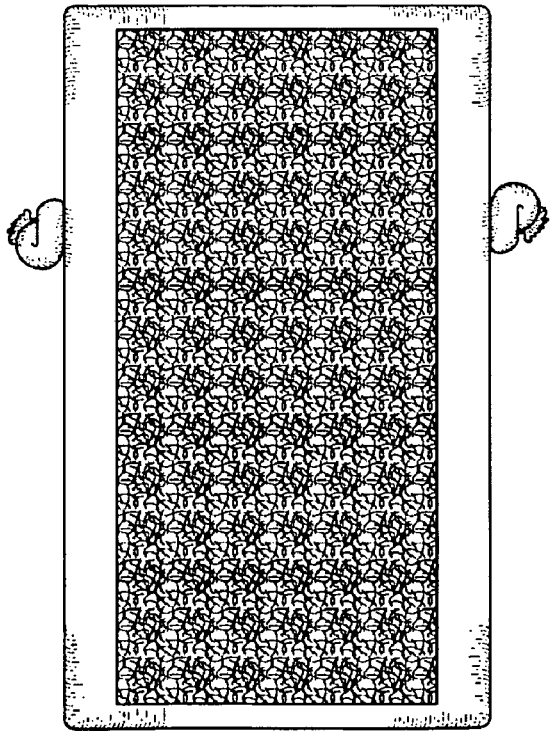
FIG. 6 is a bottom perspective view of a preferable pedal retaining unit assembly.

FIG. 6 depicts a bottom perspective view of the preferable pedal retaining unit assembly 1. Prominently displayed is the attachment surface 6. Again, Applicant has found that the preferred material for the attachment surface 6 is likely to be a hook and loop fastener system. As previously mentioned, incorporation of this type of fastener into the attachment surface 6 would provide for easy compatibility with existing systems. However, one reasonably skilled in the art could envision any variety of fastening systems that would serve the same function, such as a rubber or cork surface.

Figure 7:
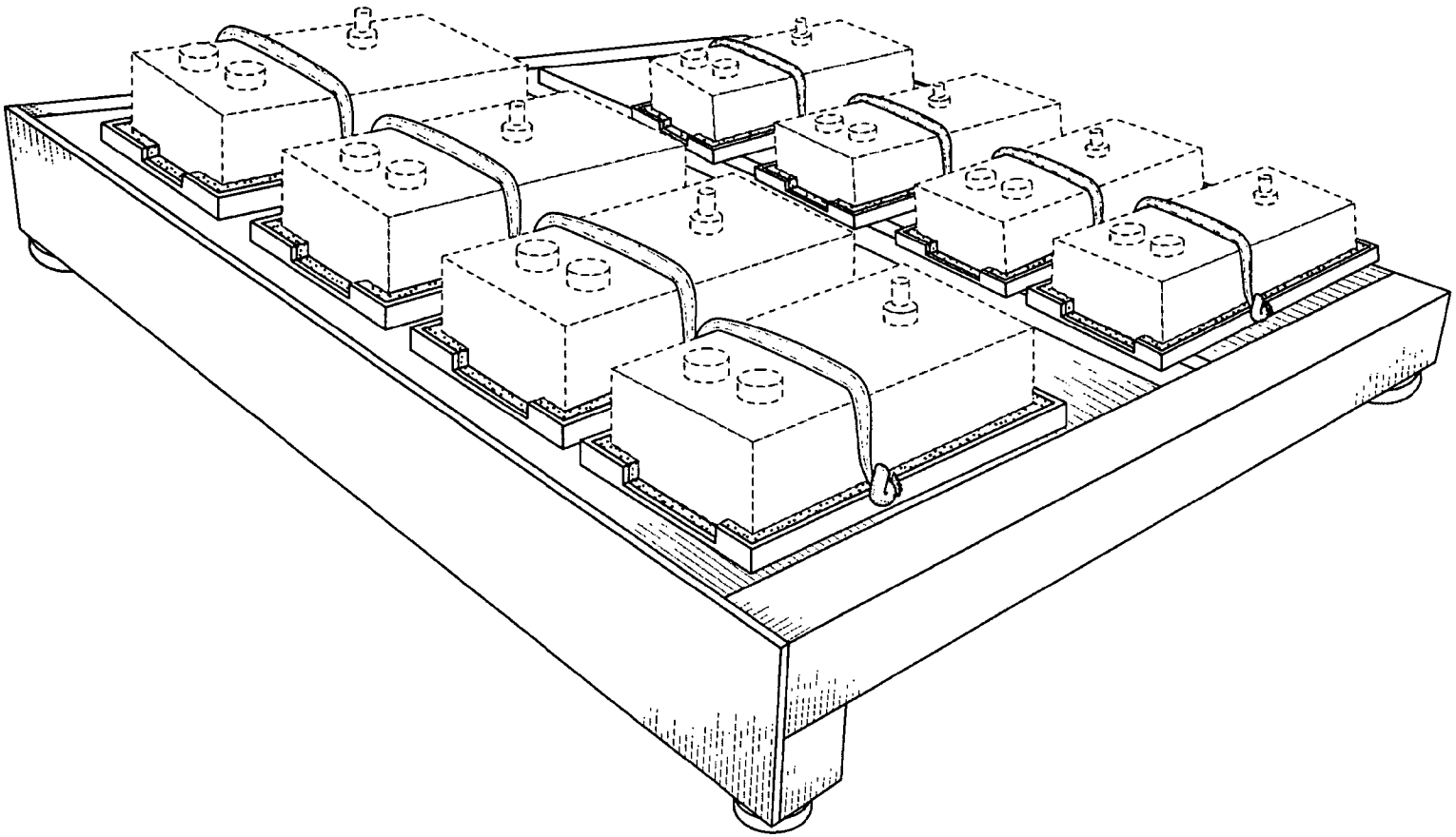
FIG. 7 is a perspective view of numerous preferable pedal retaining unit assemblies, incorporated onto a pedal board.

FIG. 7 depicts a perspective view of a pedal board system featuring a plurality of the preferable pedal retaining unit assemblies 1. As depicted, various musical effects pedals are inserted into the retaining bodies 2, and secured via the retaining means 4. The pedal retaining unit assemblies 1 are then affixed, in the user-determined position, to the pedal board 9 via an attachment surface 6, which is preferably a layer of hooks with a corresponding layer of pile, as commonly referred to as Velcro®. Thus, the effects pedals are effectively stabilized, without applying damaging adhesive to the pedals themselves.

Disclosed is a pedal retaining unit comprising a retaining body, a retaining means affixed to said retaining body by retaining means connectors; and an attachment surface fixed to an underside of said retaining body. Further disclosed is a pedal retaining unit comprising a lip disposed around the perimeter of said retaining body. Further disclosed is a pedal retaining unit further comprising an accommodation bracket at one end of said retaining body. Further disclosed is a pedal retaining unit of claim further comprising a retaining means formed from any of the group of materials consisting essentially of rubber, latex, surgical tubing, isoprene, elastic fabric, rope, string, leather, or string. Further disclosed is a pedal retaining unit wherein said retaining means is permanently fixed at one retaining means connector and removably affixed at a second retaining means connector, whereby said retaining means may be easily opened or closed and a pedal easily secured in said retaining body. Further disclosed is a pedal retaining unit wherein said retaining body is formed from any of the group of materials consisting essentially of metal alloys, aluminum, steel, wood, polyethylene, polypropylene, polyethylene terepthalate, polyvinyl choloride, polycarbonate, or actrylonitrile butadiene styrene. Further disclosed is a pedal retaining unit wherein said attachment surface is formed from a hook and loop fastener system. Further disclosed is the pedal retaining unit further comprising a retaining body inner surface fixed to a top side of said retaining body. Further disclosed is an effects pedal system comprising a pedal board; said pedal board sharing an attachment surface with at least one pedal retaining unit to removably connect said pedal board to at least one pedal retaining unit(s), said pedal retaining unit further comprising a retaining body with a retaining means attached to said retaining body by retaining means connectors. Further disclosed is an effects pedal system owherein said attachment surface is formed from a hook and loop fastener system. The effects pedal system of claim wherein said retaining means are formed from any of the group of materials consisting essentially of rubber, latex, surgical tubing, isoprene, elastic fabric, rope, string, leather, or string. A method of using and securing at least one effects pedal and preserving the pedal comprising the steps of placing an effects pedal in a retaining body; securing said effect pedal in said retaining body by using a retaining means; and fastening the combined effects pedal and retaining body to a pedal board by use of an attachment surface shared by the underside of said retaining body and a top side of said pedal board.

It is to be noted, however, that the appended drawings illustrate only typical embodiments of this invention, are not to scale, and are therefore not to be considered limiting of its scope, for the invention may admit to other equally effective embodiments which are appreciated by those skillful in the arts.

I claim:

1. A sound effects pedal retaining unit comprising:

a retaining body;

a retaining means affixed to said retaining body by retaining means connectors;

wherein said retaining means is permanently fixed at one retaining means connector and removably affixed at a second retaining means connector, whereby said retaining means may be easily opened or closed and a sound effects pedal easily secured in said retaining body; and, an attachment surface fixed to an underside of said retaining body.

2. The sound effects pedal retaining unit of claim 1, further comprising a lip disposed around the perimeter of said retaining body.

3. The sound effects pedal retaining unit of claim 1, further comprising an accommodation bracket at one end of said retaining body.

4. The sound effects pedal retaining unit of claim 1, further comprising a retaining means formed from any of the group of materials consisting essentially of rubber, latex, surgical tubing, isoprene, elastic fabric, rope, string, leather, or string.

5. A sound effects pedal retaining unit comprising:

a retaining body;

a retaining means affixed to said retaining body by retaining means connectors;

a lip disposed around the perimeter of said retaining body;

an accommodation bracket at one end of said retaining body;

a retaining means formed from any of the group of materials consisting essentially of rubber, latex, surgical tubing, isoprene, elastic fabric, rope, string, leather, or string;

wherein said retaining means is permanently fixed at one retaining means connector and removably affixed at a second retaining means connector, whereby said retaining means may be easily opened or closed and a pedal easily secured in said retaining body.

6. The sound effects pedal retaining unit of claim 1, wherein said retaining body is formed from any of the group of materials consisting essentially of metal alloys, aluminum, steel, wood, polyethylene, polypropylene, polyethylene terepthalate, polyvinyl choloride, polycarbonate, or actrylonitrile butadiene styrene.

7. The sound effects pedal retaining unit of claim 1 wherein said attachment surface is formed from a hook and loop fastener system.

8. The sound effects pedal retaining unit of claim 1, further comprising a retaining body inner surface fixed to a top side of said retaining body.

9. A sound effects pedal system comprising:

A pedal board operationally configured to receive sound effects pedals;

Said pedal board sharing an attachment surface with at least one pedal retaining unit to removably connect said pedal board to at least one pedal retaining unit(s);

Said pedal retaining unit further comprising a retaining body with a retaining means attached to said retaining body by retaining means connectors.

10. The sound effects pedal system of claim 9 wherein said attachment surface is formed from a hook and loop fastener system.

11. The sound effects pedal system of claim 9 wherein said retaining means are formed from any of the group of materials consisting essentially of rubber, latex, surgical tubing, isoprene, elastic fabric, rope, string, leather, or string.

12. A method of using and securing at least one sound effects pedal and preserving the sound effects pedal comprising the steps of:

Placing a sound effects pedal in a retaining body;

Securing said sound effects pedal in said retaining body by using a retaining means;

Fastening the combined sound effects pedal and retaining body to a pedal board by use of an attachment surface shared by the underside of said retaining body and a top side of said pedal board.

* * * * *